US008674162B2

(12) United States Patent
Ahn et al.

(10) Patent No.: US 8,674,162 B2
(45) Date of Patent: Mar. 18, 2014

(54) METHOD FOR PREPARING CERAMIC WASTE FORM CONTAINING RADIOACTIVE RARE-EARTH AND TRANSURANIC OXIDE, AND CERAMIC WASTE FORM WITH ENHANCED DENSITY, HEAT-STABILITY, AND LEACH RESISTANCE PREPARED BY THE SAME

(75) Inventors: Byung-Gil Ahn, Daejeon (KR); Hwan-Seo Park, Daejeon (KR); Hwan-young Kim, Daejeon (KR); In-Tae Kim, Daejeon (KR); Hansoo Lee, Daejeon (KR)

(73) Assignee: Korea Atomic Energy Research Institute Korea Hydro & Nuclear Power Co., Ltd. (KR)

( * ) Notice: Subject to any disclaimer, the term of this patent is extended or adjusted under 35 U.S.C. 154(b) by 950 days.

(21) Appl. No.: 12/813,827

(22) Filed: Jun. 11, 2010

(65) Prior Publication Data

US 2010/0317911 A1 Dec. 16, 2010

(30) Foreign Application Priority Data

Jun. 11, 2009 (KR) ..... 10-2009-0051790

(51) Int. Cl.
*G21F 9/00* (2006.01)

(52) U.S. Cl.
USPC ..... 588/10; 588/11; 588/12

(58) Field of Classification Search
USPC ..... 588/10–12; 501/123, 126
See application file for complete search history.

(56) References Cited

U.S. PATENT DOCUMENTS 5,973,220 A 10/1999 Sasaki et al.
2006/0129018 A1* 6/2006 Chekhmir et al. ..... 588/11

FOREIGN PATENT DOCUMENTS

KR 1020060089993 A 8/2008

OTHER PUBLICATIONS

Cho, Y.J. et al., "Characteristics of Oxidation Reaction of Rare-earth Chlorides for Precipitation in LiCl-KCl Molten Salt by Oxygen Sparging," J. Nucl. Sci. Technol. (2006) vol. 43, No. 10, pp. 1280-1286.

* cited by examiner

*Primary Examiner* — Steven Bos
(74) *Attorney, Agent, or Firm* — Fredrikson & Byron, P.A.

(57) ABSTRACT

Disclosed herein is a method for preparing a ceramic waste form containing radioactive rare-earth and transuranic oxide, and the ceramic waste form with enhanced density, heat-stability, and leach resistance prepared by the same.

10 Claims, 5 Drawing Sheets

(a) (b)

METHOD FOR PREPARING CERAMIC WASTE FORM CONTAINING RADIOACTIVE RARE-EARTH AND TRANSURANIC OXIDE, AND CERAMIC WASTE FORM WITH ENHANCED DENSITY, HEAT-STABILITY, AND LEACH RESISTANCE PREPARED BY THE SAME

CROSS-REFERENCES TO RELATED APPLICATION

This patent application claims the benefit of priority from Korean Patent Application No. 10-2009-0051790, filed on Jun. 11, 2009 the contents of which are incorporated herein by reference.

BACKGROUND OF THE INVENTION

1. Field of the Invention

The present disclosure relates to a method for preparing a ceramic waste form containing radioactive rare-earth and transuranic oxide, and the ceramic waste form with enhanced density, heat-stability, and leach resistance prepared by the same.

2. Description of the Related Art

Pyro-processing is a technology by which effective ingredients such as uranium contained in spent nuclear fuel from nuclear power plants may be recovered and recycled for fuel in fast reactors, which are the next generation nuclear reactors, in order to significantly improve uranium utilization and greatly reduce the amount, toxicity, and reduce the amount, toxicity and calorific power of high level radioactive wastes. Pyro-processing is a core technology which constitutes the backbone of future nuclear power systems, in order to largely improve the stability and economy of nuclear power generation. Unlike conventional reprocessing technology which separates only plutonium from spent nuclear fuel, pyro-processing is acknowledged as the spent nuclear fuel utilization technology for the 21st century, which does not involve the risk of nuclear proliferation because plutonium and tansuranic elements (elements heavier than uranium in atomic weight) such as neptunium, americium, curium, etc. contained in spent nuclear fuel may be extracted together through pyroprocessing.

Pyro-processing is a dry process which uses a molten salt medium and recovers or separates useful materials through electrochemical methods such as electrolytic reduction, electrolytic refining, electrowinning, etc., and has many advantages such as device compactness and increased efficiency due to high temperature reactions. The amount of waste generated may be greatly reduced by removing radioactive rare earth elements present in waste molten salt, recycling them into recyclable molten salt, and recirculating the recyclable molten salt for reuse (Y. J. Cho, J. Nucl. Sci. Technol. (2006) 43, 1280, 1286). The technology relates to a method for preparing $Nd_2O_3$, $CeO_2$, $La_2O_3$, and $Y_2O_3$, which are the main ingredients in an end waste product of powder rare earth oxide radioactive waste, into a stable waste form appropriate for final disposal. The preparation of a stable waste form refers to a process which uses a solidification medium to prepare powder rare earth oxide radioactive waste into a stable waste form aggregate, and the solidification medium used must contain a quantity of physically/chemically stable powder radioactive waste. Korean Patent Publication No. 1998-024918 describes a method for treating radioactive solid waste containing aluminum by using a waste form with excellent mechanical strength and characteristics, which prevents nuclides from releasing by reacting radioactive solid waste containing metal aluminum with alkaline solution, generating hydrogen gas, and adding a solidification material containing a potential hydraulic material as a main reactant ingredient. Korean Patent No. 757200 relates to a method for preparing immobilization product of waste chloride salts using zeolite only, and more particularly to a method for preparing immobilization product of waste chloride salts using zeolite only, including: mixing an alkali or alkaline earth metal such as Cesium (Cs), Strontium (Sr), Barium (Ba), etc., or a rare earth-based radioactive nuclide with zeolite to prepare an immobilization intermediate; and converting the immobilization intermediate into an Na-sodalite.

Although there are various methods in conventional technology for preparing radioactive waste into a waste form according to subjects to be solidified, there are no research results on preparation of waste consisting only of radioactive rare earth and transuranic oxide into a waste form. A waste form is prepared by a vitrification method commercially applied for treatment of high-level waste, including melting/decomposing borosilicate glass medium with a waste to be solidified (slurry generated during the wet process) at about 1400-1500° C. in an induction furnace, pouring the melt into a solidification drum, and subjecting it to a heat treatment in order to prevent cracking. Due to problems such as control of internal compositions for high frequency induction, maintenance, replacement of internal structural materials according to corrosion, complicated elements, and collection of highly volatile nuclides due to high temperatures, there are many difficulties in maintenance and much waste production. Because rare earth oxide in glass melt has a high tendency to make glass components crystalline and is precipitated to the bottom of the melt, it is difficult to prepare a homogeneous glass waste form.

Thus, the present inventors have performed studies on methods for preparing waste form containing radioactive rare earth oxide, used a ceramic solidification medium including $CaHPO_4$ which converts rare-earth oxide into a stable monazite mineral, $Zn_2TiO_4$ which has excellent radioactive resistance, and $SiO_2$, $B_2O_3$ or $H_3BO_3$ which serves as lowering the sintering temperature and improve the properties of the waste form, developed a method for preparing ceramic waste form containing radioactive rare earth and transuranic oxide which may be prepared from sintering at temperatures of 1000° C. or less, and completed the present invention.

SUMMARY OF THE INVENTION

The present invention provides a method for preparing a ceramic waste form containing radioactive rare earth and transuranic oxide. In some embodiments of a method according to the invention, a ceramic waste form containing radioactive rare earth and transuranic oxide with enhanced density, heat-stability, and leach resistance can be prepared.

One embodiment of the present invention provides a method for preparing a ceramic waste form containing radioactive rare earth and transuranic oxide prepared at low temperatures such as 1000° C. or lower, including: preparing $CaHPO_4$ and $Zn_2TiO_4$ (Step 1); mixing 50-65% $Zn_2TiO_4$ by weight and 15-20% $CaHPO_4$ by weight, prepared in Step 1, with 8-12% $SiO_2$ by weight and 12-18% $B_2O_3$ by weight or 24-36% $H_3BO_3$ by weight to form a mixed powder (Step 2); sintering the mixed powder prepared in Step 2 in the atmosphere of air, cooling the mixture naturally, and grinding the mixture to prepare a solidification medium (Step 3); and mixing 60-90% of the solidification medium by weight, prepared in Step 3, with 1-40% radioactive rare earth and transuranic oxide by weight and sintering the mixture in the atmosphere of air to prepare a ceramic waste form (Step 4).

The present invention also provides a ceramic waste form containing radioactive rare earth and transuranic oxide. In an embodiment, the ceramic waste form of this embodiment is comprised 10-40% radioactive rare earth and transuranic oxide by weight and 60-90% of a solidification medium by weight. The solidification medium can comprise a sintered mixture of 50-65% $Zn_2TiO_4$ by weight, 15-20% $CaHPO_4$ by weight, 8-12% $SiO_2$ by weight and 12-18% $B_2O_3$ by weight or 24-36% $H_3BO_3$ by weight.

The ceramic waste form of the invention may have enhanced density, heat-stability, and/or leach resistance.

DESCRIPTION OF THE PREFERRED EMBODIMENTS

Figure 1:
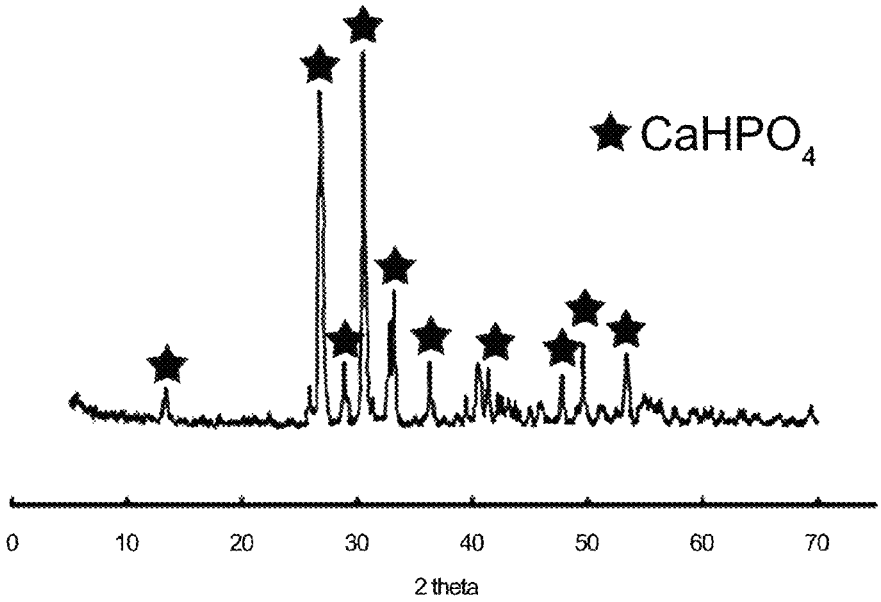
FIG. 1 is a result of $CaHPO_4$ phase prepared in Step 1 according to the present invention analyzed by an X-ray diffractometer.

Features and advantages of the present invention will be more clearly understood by the following detailed description of the present preferred embodiments by reference to the accompanying drawings. It is first noted that terms or words used herein should be construed as meanings or concepts corresponding with the technical sprit of the present invention, based on the principle that the inventor can appropriately define the concepts of the terms to best describe his own invention. Also, it should be understood that detailed descriptions of well-known functions and structures related to the present invention will be omitted so as not to unnecessarily obscure the important point of the present invention.

In an embodiment, the present invention provides a method for preparing a ceramic waste form containing radioactive rare earth and transuranic oxide prepared at low temperatures such as 1000° C. or lower, including: preparing $CaHPO_4$ and $Zn_2TiO_4$ (Step 1); mixing 50-65% $Zn_2TiO_4$ by weight and 15-20% $CaHPO_4$ by weight, prepared in Step 1, with 8-12% $SiO_2$ by weight and 12-18% $B_2O_3$ by weight or 24-36% $H_3BO_3$ by weight to form a mixed powder (Step 2); sintering the mixed powder prepared in Step 2 in the atmosphere of air, cooling the mixture naturally, and grinding the mixture to prepare a solidification medium (Step 3); and mixing 60-90% of the solidification medium by weight, prepared in Step 3, with 10-40% radioactive rare earth and transuranic oxide by weight and sintering the mixture in the atmosphere of air to prepare a ceramic waste form (Step 4).

Hereinafter, an embodiment of a method of the present invention will be described step-by-step in detail.

First, Step 1 according to the present invention is a step in which $CaHPO_4$ and $Zn_2TiO_4$ are prepared.

$CaHPO_4$ represented by following Formula 1 in Step 1 may be preferably prepared by diluting $Ca(OH)_2$ and $H_3PO_4$ at an equal molar ratio in distilled water, followed by stirring while adding the two materials bit by bit to the dilution.

$$Ca(OH)_2+H_3PO_4+H_2O=CaHPO_4+2H_2O \quad \text{[Formula 1]}$$

In the preparation of $CaHPO_4$, the diluting may be preferably performed by diluting $Ca(OH)_2$ powder and $H_3PO_4$ in distilled water of volumes, but not limited to, about 3 times and about 7 times greater than those of the powders, respectively. $Zn_2TiO_4$ represented by following Formula 2 in Step 1 may be preferably prepared by mixing ZnO and $TiO_2$ at a molar ratio of 2:1, sintering the mixture, cooling the sintered mixture, followed by grinding. The mixing may be performed by a method, including: adding alcohol which does not affect the reaction, mixing the components in the form of slurry, and drying the mixture.

$$2ZnO+TiO_2=Zn_2TiO_4 \quad \text{[Formula 2]}$$

In the preparation of $Zn_2TiO_4$, the sintering may be preferably performed at 800-900° C. for 2-6 hours. The sintering may be appropriately performed at a temperature of 800° C. or greater and for 2 hours or more. However, when the sintering temperature and time exceed 900° C. and 6 hour, respectively, excessive energy may be consumed in terms of energy efficiency.

In the preparation of $Zn_2TiO_4$, the grinding may be preferably performed by roll mill, hammer mill, disk mill, etc. such that particle diameters may be 10-60 μm, and more preferably by disk mill.

Next, Step 2 according to the present invention is a step in which 50-65% $Zn_2TiO_4$ by weight and 15-20% $CaHPO_4$ by weight, prepared in Step 1, are mixed with 8-12% $SiO_2$ by weight and 12-18% $B_2O_3$ by weight to form a mixed powder. In each material mixed in Step 2, $CaHPO_4$ is added to convert rare earth and transuranic oxide into a stable monazite, $Zn_2TiO_4$ is added to enhance the radioactive resistance and leach resistance, and $SiO_2$, $B_2O_3$, and $H_3BO_3$ are added to lower the sintering temperature and improve the properties. When the weight percentages of the materials exceed the ranges, problems, such as an increase in sintering temperature, a decrease in durability of waste forms, and an increase in leach of radioactive materials, may occur.

$H_3BO_3$ may be used in stead of the $B_2O_3$ in Step 2, and $H_3BO_3$ may be preferably used at an amount twice than that of $B_2O_3$.

In addition, the mixing in Step 2 may be performed by a dry or wet mixing process. The wet mixing may be preferably performed by using alcohol, stirring the mixture, followed by drying. The alcohol may be preferably a lower alcohol which is highly volatile and may be easily removed after the mixture is kneaded, more preferably methanol and ethanol, and a homogenous mixture may be formed with the use of the alcohol.

Next, Step 3 according to the present invention is a step in which the mixed powder prepared in Step 2 is sintered in the atmosphere of air and the mixture is naturally cooled, followed by grinding to prepare a solidification medium. The sintering in Step 3 may be preferably performed at 700-900° C. at 5-15° C./min for 2-5 hours. The sintering may be appropriately performed at a temperature of 700° C. or greater for 2 hours or more. However, when the sintering temperature and time exceed 900° C. and 5 hour, respectively, excessive energy may be consumed in terms of energy efficiency.

The grinding in Step 3 according to the present invention may be preferably performed by roll mill, hammer mill, disk mill, etc. such that particle diameters may be 10-60 μm, and more preferably by disk mill.

Next, Step 4 according to the present invention is a step in which the solidification medium prepared in Step 3 is mixed with radioactive rare earth and transuranic oxide, followed by sintering in the atmosphere of air to prepare a ceramic waste form.

In the ceramic waste form prepared in Step 4, the content of the solidification medium prepared in Step 3 may be preferably 60-90% by weight, while that of the radioactive rare earth and transuranic oxide may be preferably 10-40% by weight. When the content of the solidification medium is less than 60% by weight, an unstable waste form may be formed due to a low content of the solidification medium which may contain radioactive rare earth and transuranic oxide stably. When the content of the solidification medium is more than 90% by weight, a waste form with excellent properties may be prepared. However, an inefficient ceramic waste form may be formed because the waste form contains a small amount of radioactive rare earth oxide and transuranic as a waste. When the content of the radioactive rare earth and transuranic oxide is less than 10% by weight, an inefficient ceramic waste form may be formed due to a low content of the radioactive rare earth and transuranic oxide. When the content exceeds 40% by weight, an unstable waste form may be formed due to a low content of the solidification medium.

Furthermore, the sintering in Step 4 may be preferably performed at 800-1000° C. at a heating rate of 5-15° C./min for 3-5 hours. The sintering may be preferably performed at 800° C. or greater for 3 hours or more, respectively. However, when the sintering temperature and time exceed 1000° C. and 5 hour, respectively, excessive energy may be consumed in terms of energy efficiency.

The present invention also provides a ceramic waste form containing radioactive rare earth and transuranic oxide with enhanced density, wherein the waste form contains 60-90% of the solidification medium prepared by the preparation method described above by weight and 10-40% radioactive rare earth oxide by weight.

Referring to Experimental Example 2 on density, it can be seen that conventional glass waste forms show a density of 2.5 g/cm$^2$ or less and the ceramic waste form according to the present invention shows an increased density of 3.5 g/cm$^2$ or more. Thus, the ceramic waste form may include more rare earth oxide per unit volume than the conventional waste forms.

Furthermore, the present invention provides a ceramic waste form containing radioactive rare earth oxide with enhanced heat-stability, wherein the waste form contains 60-90% of the solidification medium prepared by the preparation method described above by weight and 10-40% radioactive rare earth oxide by weight.

Referring to Experimental Example 2 on heat conductivity, conventional glass waste forms show a heat conductivity of about 1.1 W/(m·K) or less and the ceramic waste form according to the present invention shows a heat conductivity of 1.7 W/(m·K) or more. Thus, the ceramic waste form has enhanced heat-stability due to an increase in heat emission efficiency.

The present invention also provides a ceramic waste form containing radioactive rare earth oxide with enhanced leach resistance, wherein the waste form contains 60-90% of the solidification medium prepared by the preparation method described above by weight and 10-40% radioactive rare earth oxide by weight.

Referring to Experimental Example 3 on leaching rate, radioactive materials are releasing from conventional glass waste forms at a leaching rate of about $1\times10^{-4}$ g/(m$^2$·day), while releasing from the ceramic waste form according to the present invention at a leaching rate of about $1\times10^{-5}$ g/(m$^2$·day). Thus, it can be seen that the leach resistance is enhanced due to a decrease in leaching rate.

Hereinafter, the present invention will be described in more detail with reference to Examples. However, the following examples are provided for illustrative purposes only, and the scope of the present invention should not be limited thereto in any manner.

Example 1

Preparation of Ceramic Waste Form Containing Radioactive Rare Earth Oxide 42.5% $Ca(OH)_2$ by weight was diluted in distilled water of a volume about 3 times greater than that of the material and 57.5% $H_3PO_4$ by weight was diluted in distilled water of a volume about 7 times greater than that of the compound. The two materials were added bit by bit to the dilution while stirring. The precipitate was washed and filtered at about 90° C., and dried for 2 days to prepare $CaHPO_4$. After 67.1% ZnO by weight and 32.9% $TiO_2$ by weight were mixed, the mixture was sintered at 900° C. for 4 hours, cooled, and ground by disk mill to prepare $Zn_2TiO_4$ such that particle diameters might be 10-60 μm. 56% and 18% of $Zn_2TiO_4$ and $CaHPO_4$ by weight, respectively, prepared by the method, were mixed with 10% $SiO_2$ as a commercial material by weight and 16% $B_2O_3$ by weight, ethanol corresponding to 3% of the powder mixture by weight was added to the mixture, which was later stirred by ball mill for 1 day, followed by drying at 90° C. for 2 days. The mixture was sintered in the atmosphere of air at 850° C. at 10° C./min for 4 hours and cooled naturally, followed by grinding by disk mill to prepare a solidification medium such that particle size might be 10-60 μm. 30% of a mixed rare earth oxide (composition: 59% $Nd_2O_3$ by weight, 23% $CeO_2$ by weight, 12% $La_2O_3$ by weight, and 6% $Y_2O_3$ by weight) by weight was added to the solidification medium, mixed together, put into an alumina crucible, and sintered in the atmosphere of air at 950° C. at 10° C./min for 4 hours to prepare a ceramic waste form containing radioactive rare earth oxide (See FIG. 3(*b*)).

Comparative Example 1

Figure 3:
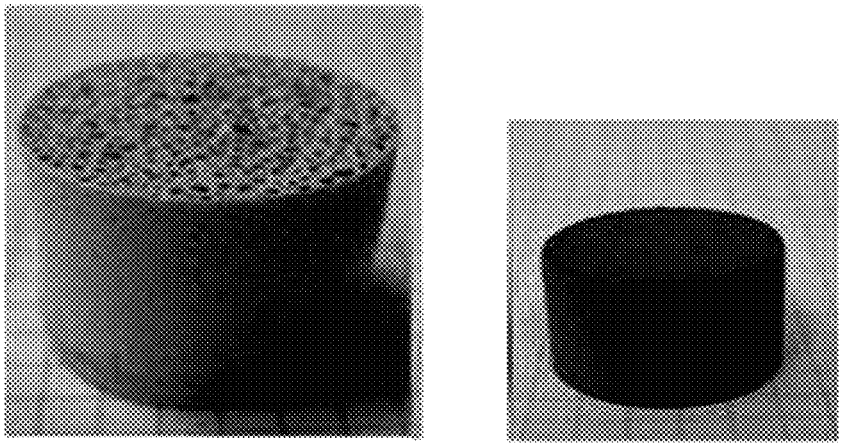
FIG. 3 is a group of photos of the surfaces of a ceramic waste form containing radioactive rare earth oxide according to the present invention and a glass waste form (FIG. 3(*a*): Comparative Example 1 and FIG. 3(*b*): Example 1)

Preparation of Glass Waste Form Solidified into Borosilicate Glass Containing Radioactive Rare Earth Oxide A glass waste form was prepared in the same manner as in Step 4 in the Example 1 described above except that borosilicate glass was used as a solidification medium (See FIG. 3(*a*)).

Analysis. Phase analysis of $CaHPO_4$ and $Zn_2TiO_4$

Figure 2:
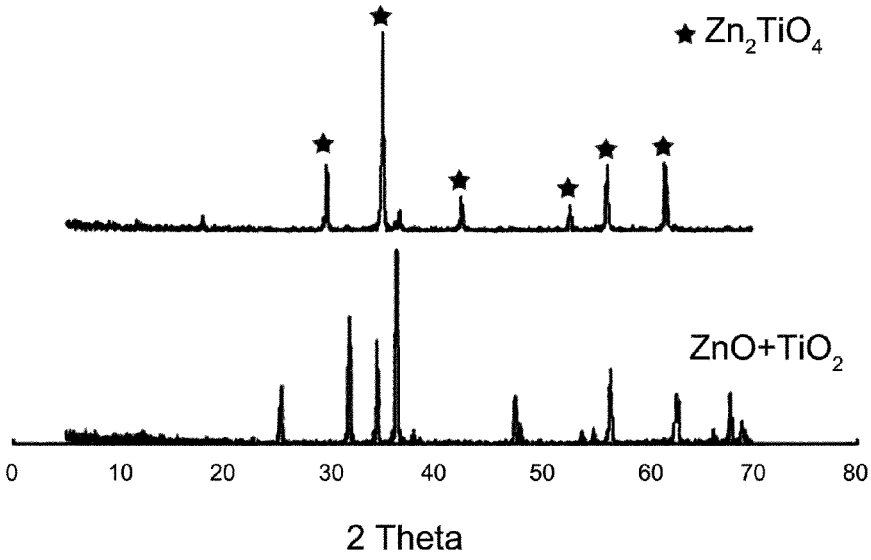
FIG. 2 is a result of $Zn_2TiO_4$ phase prepared in Step 1 according to the present invention analyzed by an X-ray diffractometer.

A phase analysis was performed on $CaHPO_4$ and $Zn_2TiO_4$ using an X-ray diffractometer (XRD), and the results are shown in FIGS. 1 and 2.

As illustrated in FIGS. 1 and 2, main peaks are identified to be $CaHPO_4$ and $Zn_2TiO_4$.

Experimental Example 1

Surface Analyses of Ceramic Waste Form Containing Radioactive Rare Earth Oxide and Glass Waste Form The two waste forms were photographed in order to analyze the surfaces of ceramic waste form containing radioactive rare earth oxide and glass waste form, and the results are shown in FIG. 3.

As illustrated in FIG. 3, surface analyses reveal that the ceramic waste form in Example 1 had small pore size and formed dense shapes on its surface while glass waste form in comparative Example 1 had big pore formed on its surface.

Experimental Example 2

Figure 4:
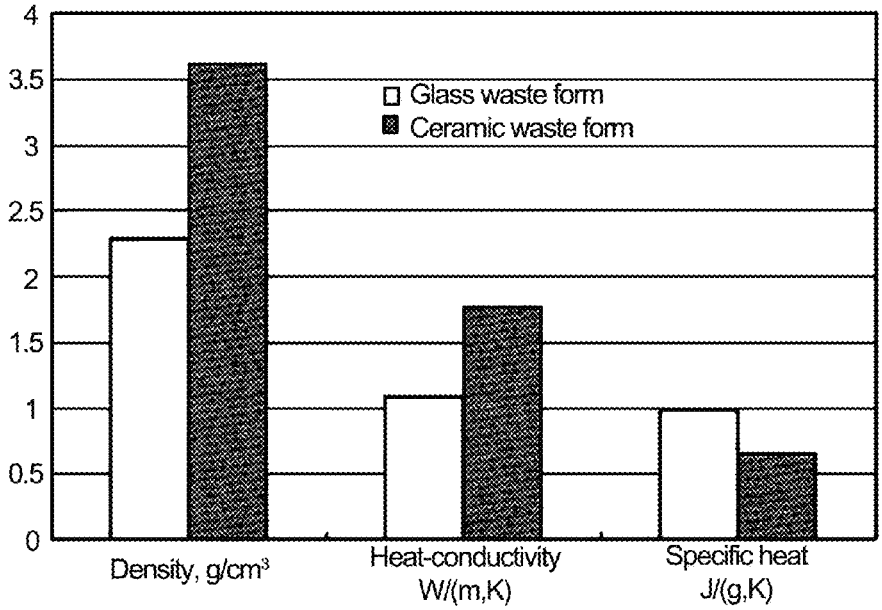
FIG. 4 is a graph illustrating analysis results of density, heat conductivity, and specific heat between a ceramic waste form containing radioactive rare earth oxide according to the present invention and a glass waste form in order to analyze physical properties of the waste forms.

Analysis of Physical Properties of Ceramic Waste Form Containing Radioactive Rare Earth Oxide and Glass Waste Form Densities, heat conductivities and specific heats of a ceramic waste form containing radioactive rare earth oxide and a glass waste form were analyzed for analysis of physical properties of the waste forms, and the results are shown in FIG. 4.

As illustrated in FIG. 4, it can be seen that the ceramic waste form in Example 1 had a density of 3.6 g/nm$^3$, which was greater than 2.3 g/cm$^3$ of the glass waste form in Comparative Example 1. The ceramic waste form had a heat-conductivity at about 1.8 W/(m·K), which was greater than that of the glass waste form at about 1.1 W/(m·K). It can be also seen that the specific heat of the ceramic waste form was about 0.65 J/(g·K), which was smaller than that of the glass waste form at about 1 J/(g·K). Therefore, because heat was more easily released from the ceramic waste form in Example 1 than from the glass waste form in Comparative Example 1, the heat-stability of the ceramic waste form was found to be enhanced.

Experimental Example 3

Figure 5:
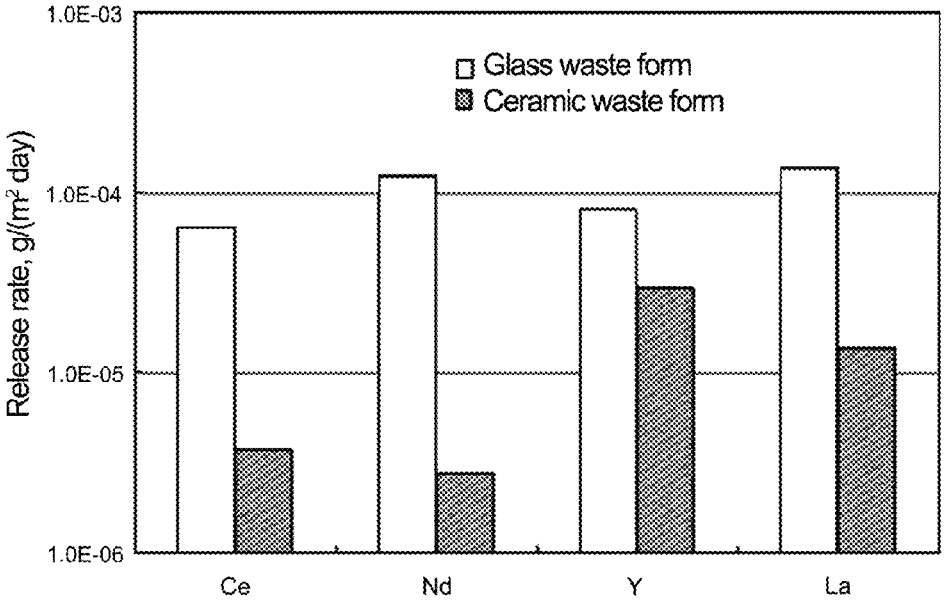
FIG. 5 is a graph illustrating leaching rates obtained in order to analyze leaching properties of a ceramic waste form containing radioactive rare earth oxide according to the present invention and a glass waste form.

Analysis of Leaching Properties of Ceramic Waste Form Containing Radioactive Rare Earth Oxide and Glass Waste Form Each leaching rate was obtained from a ceramic waste form containing radioactive rare earth oxide and a glass waste form in order to analyze leaching properties of the waste forms, and the results are shown in FIG. 5.

The ceramic waste form in Example 1 and the glass waste form in Comparative Example 1 were ground, and powders on a 200-300 mesh were recovered. The recovered powders were put in distilled water and then reacted at 90 C. for 7 days. The content of each rare earth element present in the leachate was analyzed to obtain a leaching rate.

As illustrated in FIG. 5, the ceramic waste form in Example 1 shows a low leaching rate for the total rare earth elements. The ceramic waste form had a leaching rate of about $1\times10^{-5}$ g/(m$^2$·day) except for the yttrium (Y) element, while the glass waste form had a leaching rate of about $1\times10^{-4}$ g/(m$^2$·day)), which was 10 times slower than that of the ceramic waste form. From this, it can be seen that the ceramic waste form in Example 1 according to the present invention has a very low release rate of radioactive material.

The preparation method of a ceramic waste form containing radioactive rare earth oxide according to the present invention is a method by which the ceramic waste form may be prepared at low temperatures such as 1000° C. or lower by simple mixing and powder phase sintering. A ceramic waste form prepared by the method shows enhanced density and heat-stability, and enhanced leach resistance due to a very low release rate of radioactive material, and thus the ceramic waste form may be usefully used to prepare nuclear waste including radioactive rare earth oxide into a stable waste form.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method for preparing a ceramic waste form containing radioactive rare earth and transuranic oxide prepared at low temperatures of 1000° C. or lower, comprising:

preparing $CaHPO_4$ and $Zn_2TiO_4$ (Step 1);

mixing 50-65% $Zn_2TiO_4$ by weight and 15-20% $CaHPO_4$ by weight, prepared in Step 1, with 8-12% $SiO_2$ by weight and 12-18% $B_2O_3$ by weight or 24-36% $H_3BO_3$ by weight to form a mixed powder (Step 2);

sintering the mixed powder prepared in Step 2 in air, cooling the sintered mixed powder naturally, and grinding the cooled mixed powder to prepare a solidification medium (Step 3); and mixing 60-90% of the solidification medium by weight, prepared in Step 3, with 10-40% radioactive rare earth and transuranic oxide by weight and sintering the mixture in air to prepare a ceramic waste form (Step 4).

2. The method as set forth in claim 1, wherein the $Zn_2TiO_4$ in Step 1 is prepared by sintering a mixture of ZnO and $TiO_2$ at 800-900° C. for 2-6 hours.

3. The method as set forth in claim 1, wherein the mixing in Step 2 is performed by a dry or wet mixing process.

4. The method as set forth in claim 1, wherein the mixing in Step 2 is a wet mixing process performed by adding methanol or ethanol to the mixed powder, stirring the mixture, and drying the mixture to provide the mixed powder.

5. The method as set forth in claim 1, wherein the sintering in Step 3 is performed by heating the mixed powder prepared in Step 2 at a rate of 5-15° C./min up to a sintering temperature range of 700-900° C. and holding at the sintering temperature range for 2-5 hours.

6. The method as set forth in claim 1, wherein the grinding in Step 3 is performed by any one of roll mitt, hammer mill, and disk mill such that particle diameters are 10-60 μm.

7. The method as set forth in claim 1, wherein the sintering in Step 4 is performed by heating the mixed powder at a heating rate of 5-15° C./min up to a sintering temperature range of 800-1000° C. and holding at the sintering temperature range for 3-5 hours.

8. A ceramic waste form comprising radioactive rare earth and transuranic oxide with enhanced density, wherein the waste form comprises 60-90% of a solidification medium by weight and 10-40% radioactive rare earth and transuranic oxide by weight, wherein the solidification medium is comprised of a sintered mixture of 50-65% $Zn_2TiO_4$by weight, 15-20% $CaHPO_4$ by weight, 8-12% $SiO_2$ by weight and 12-18% $B_2O_3$ by weight or 24-36% $H_3BO_3$ by weight.

9. A ceramic waste form comprising radioactive rare earth oxide with enhanced heat-stability, wherein the waste form comprises 60-90% of a solidification medium by weight and 10-40% radioactive rare earth and transuranic oxide by weight, wherein the solidification medium is comprised of a sintered mixture of 50-65% $Zn_2TiO_4$ by weight, 15-20% $CaHPO_4$ by weight, 8-12% $SiO_2$ by weight and 12-18% $B_2O_3$ by weight or 24-36% $H_3BO_3$ by weight.

10. A ceramic waste form comprising radioactive rare earth and transuranic oxide with enhanced leach resistance, wherein the waste form comprises 60-90% of a solidification medium by weight and 10-40% radioactive rare earth and transuranic oxide by weight, wherein the solidification medium is comprised of a sintered mixture of 50-65% $Zn_2TiO_4$ by weight, 15-20% $CaHPO_4$ b weight, 8-12% $SiO_2$ weight and 12-18% $B_2O_3$ by weight or 24-36% $H_3BO_3$ by weight.

* * * * *